US007007420B2

(12) United States Patent
Garcia

(10) Patent No.: US 7,007,420 B2
(45) Date of Patent: Mar. 7, 2006

(54) BARRICADE SIGN

(75) Inventor: Guadalupe C. Garcia, Modesto, CA (US)

(73) Assignee: Worldwide Safety, LLC, Sacramento, CA (US)

( * ) Notice: Subject to any disclaimer, the term of this patent is extended or adjusted under 35 U.S.C. 154(b) by 0 days.

(21) Appl. No.: 10/900,257

(22) Filed: Jul. 26, 2004

(65) Prior Publication Data

US 2005/0091895 A1 May 5, 2005

Related U.S. Application Data

(63) Continuation-in-part of application No. 10/131,316, filed on Apr. 23, 2002, now Pat. No. 6,766,760.

(60) Provisional application No. 60/495,229, filed on Aug. 13, 2003.

(51) Int. Cl.
*G09F 15/00* (2006.01)

(52) U.S. Cl. ..... 40/610; 40/612; 40/601; 40/602; 40/606.15; 116/63 P

(58) Field of Classification Search ..... 40/612, 40/610, 601, 602, 606.15, 903; 116/63 P, 116/63 T; 404/6; 256/13.1; 446/310; D21/589
See application file for complete search history.

(56) References Cited

U.S. PATENT DOCUMENTS

| | | | | |
|---|---|---|---|---|
| 1,776,447 A | * | 9/1930 | Parkhurst | 404/10 |
| 2,164,985 A | * | 7/1939 | Cardarelli | 40/610 |
| 2,446,540 A | * | 8/1948 | Leach | 446/310 |
| 2,598,807 A | * | 6/1952 | Lawson, Jr. et al. | 446/9 |
| 3,037,779 A | * | 6/1962 | Duncan | 446/310 |
| 3,134,184 A | * | 5/1964 | Neblett | 49/131 |
| 3,734,595 A | * | 5/1973 | Bendzick | 359/553 |
| 4,019,271 A | * | 4/1977 | Latimer | 40/603 |
| 4,507,887 A | | 4/1985 | Seely | 40/610 |
| 4,745,960 A | | 5/1988 | Karp | 160/84.07 |
| 5,082,249 A | | 1/1992 | Havlovitz | 256/64 |
| 5,303,668 A | | 4/1994 | Huang | 116/63 P |
| 5,488,792 A | * | 2/1996 | Kwok | 40/612 |
| 6,053,657 A | | 4/2000 | Signorelli | 404/6 |

(Continued)

FOREIGN PATENT DOCUMENTS

GB 2186729 A * 8/1987

OTHER PUBLICATIONS

Possibilities, Curious George Jack-in-the-Box, Dec. 2000, http://www. possibilitiesshop.com/CuriousGeorgeJack-intheBox.html.*

*Primary Examiner*—Gary C. Hoge
(74) *Attorney, Agent, or Firm*—Lumen Intellectual Property Services, Inc.

(57) ABSTRACT

The present invention provides a barricade sign that is compact, portable, safe, durable, versatile, and weather/wind resistant. The barricade sign distinguishes a base and a lid that are pivotally connected together. The base supports the lid and has a compartment for storing one or more safety cones or signs that can be reduced to a small volume, or any other items related to road safety. One side of the lid has a positioning element for securing the cones in place. The other side implements a desired sign. The connection between the base and the lid is configured to hold up the sign in a stable, sustainable, wind resisting manner in absence of impact and to collapse, fold, close, or break upon impact. In such an encounter, the overall height and the layered or curved shape enable the barricade sign to act like a speed bump, thereby minimizing or eliminating damages.

17 Claims, 11 Drawing Sheets

U.S. PATENT DOCUMENTS 6,115,951 A 9/2000 Jing et al. ..... 40/610
6,435,762 B1 * 8/2002 Markling ..... 404/6
6,625,912 B1 9/2003 Dicke et al. ..... 40/610
6,766,760 B1 * 7/2004 Garcia ..... 116/63 C

* cited by examiner

BARRICADE SIGN

CROSS-REFERENCE TO RELATED APPLICATIONS

This is a continuation-in-part application of the U.S. patent application Ser. No. 10/131,316, filed Apr. 23, 2002, now allowed and to be issued as the U.S. Pat. No. 6,766,760. This application also claims the benefit of the Provisional Patent Application No. 60/495,229, filed Aug. 13, 2003, the entire content of which is incorporated herein by reference.

BACKGROUND OF THE INVENTION

1. Field of the Invention

The present invention generally relates to portable road signs. More specifically, the present invention relates to barricade signs and roll-up signs.

2. Description of the Related Art

Road signs are useful in alerting, informing, directing, or diverting motorists as well as pedestrians to avoid or pass safely around hazards, obstacles, work zones, and so on. In addition to standard roll-up warning and informational signs, many road sign designs exist.

For example, a portable and compact retrorefloective sign system disclosed in the U.S. Pat. No. 6,115,951 and issued to Jing et al. includes a base, a winding mechanism roller attached to the base, and a retroreflective roll-up sheeting having a first end and a second end. The first end is attached to the roller and the sign is wound about the roller.

U.S. Pat. No. 4,507,887, issued to Seely, discloses a portable sign system with a frame member for mounting a sign and a means to allow the sign to pivot or swing under side-wind loads by action of a resilient portion of the stand.

These and other prior road sign designs, although very useful, are not particularly easy to carry, nor are they suitable for storing in places where space is limited, for instance, in the trunk or cargo area of a vehicle. Furthermore, most existing designs lack the capability to withstand strong wind, for example, over 10 mph. Non-collapsible ones have an additional drawback of possibly causing greater damages to pedestrians, vehicles and/or other properties when hit by a car or blown over by wind.

Therefore, although many prior designs exist, there is a continuing need in the art for a compact portable road sign providing maximum visibility, high safety, substantial versatility, and strong wind resistance. The present invention addresses this need.

SUMMARY OF THE INVENTION

The present invention provides a road sign, hereinafter referred to as a barricade sign, that is compact, portable, durable, versatile, and weather/wind resistant. According to an aspect of the invention, the barricade sign distinguishes two parts—a base and a lid—that are pivotally connected. The base supports the lid and has a compartment for storing one or more items inside. The shapes of the base as well as its compartment can vary depending upon design and/or desire.

In some embodiments, the compartment is configured to store one or more safety cones, warning/traffic signs such as roll up signs, or any other items related to road safety that can be reduced to a small volume. Preferably, the compartment stores one, two, three, or more flexible safety cones disclosed in the above referenced U.S. Pat. No. 6,766,760.

The lid is latched onto the base with a closing means such as a latch, clip, hook, strap, click-mechanism, pin, lock, or the like. One side of the lid may include a positioning element to facilitate securing one or more flexible safety cones in place. The other side of the lid implements a desired sign, e.g., a warning sign, a traffic sign, an informational sign, etc.

The connection between the base and the lid is configured 1) to hold up the sign in a stable, sustainable, wind resisting manner in absence of a direct impact force, and 2) to collapse, fold, close, or break upon impact, e.g., when hit by a car. Once collapsed, folded, or closed, the overall height and the layered or curved shape enable the barricade sign to act more or less like a speed bump. Such a safety construction advantageously eliminates or otherwise significantly minimizes damages to the vehicle involved as well as surrounding traffic.

Other objects and advantages of the present invention will become apparent to one of ordinary skill in the art upon reading and understanding the detailed description of the preferred embodiments below with reference to the following drawings.

DETAILED DESCRIPTION OF THE PREFERRED EMBODIMENTS

Figure 1:
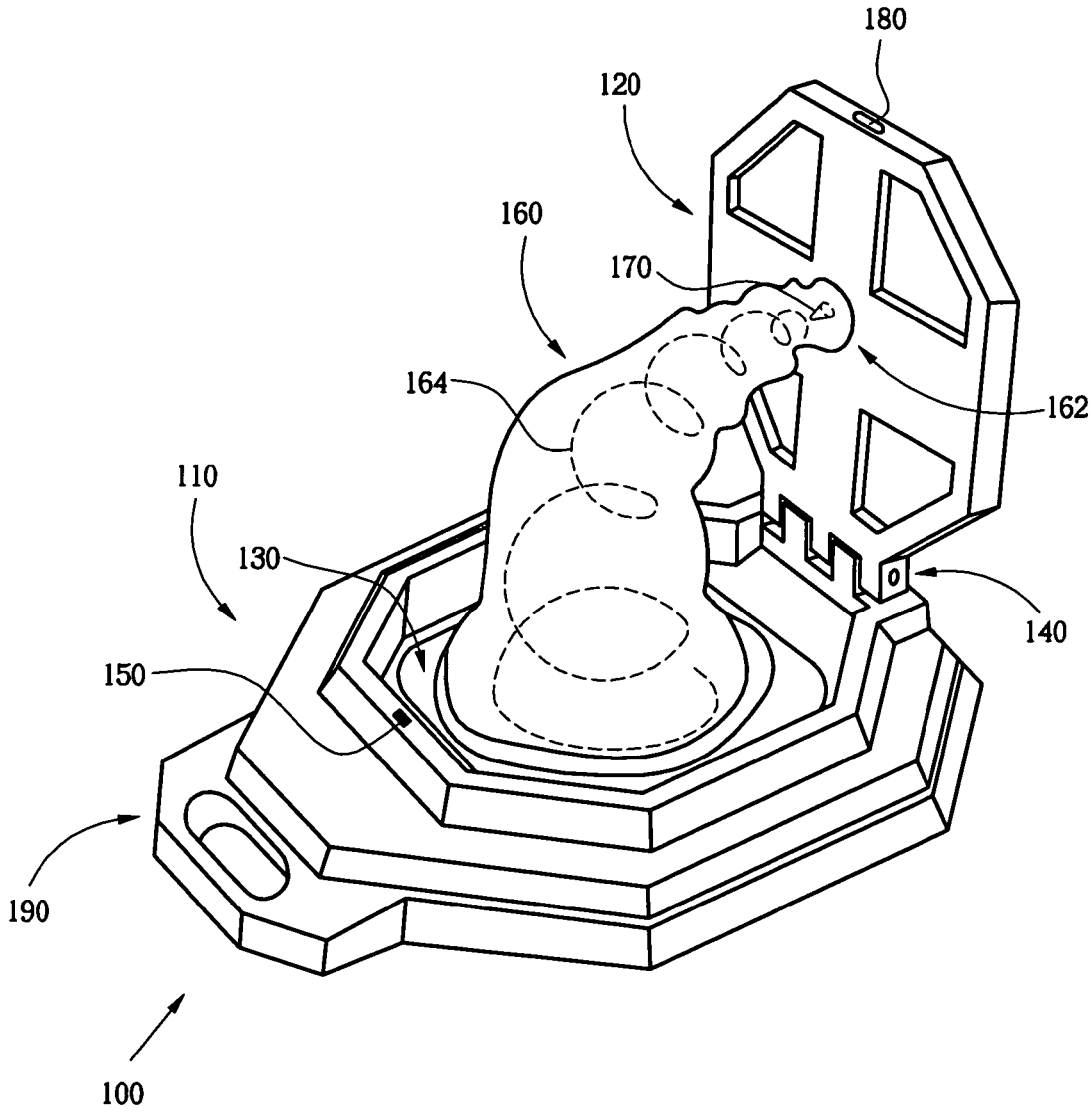
FIGS. 1–2 show exemplary embodiments of a barricade sign according to the present invention.

The present invention provides a barricade sign 100 as shown in FIG. 1. The barricade sign distinguishes two parts 110, 120. The first part 110 is a base with a compartment 130. The second part 120 is a lid. Dependent on the manufacturing procedure of choice, parts 110, 120 could either be separate parts that are connected by a joint 140 or could be an integral construction that is created by, for instance, but not limited to, injection molding or blow molding. In either case, part 120 is pivotally connected to part 110 in such a manner that it could close and store items inside compartment 130.

Lid 120 could be held closed with a closing means 150 such as, but not limited to, a latch, strap, hook, clip, click-mechanism, pin, lock, or the like. The barricade sign is preferably made out of a rubber material. It would also be preferred to avoid any type of metal to manufacture or assemble the barricade sign. The outside shape of the base could be layered as shown in FIG. 1. However, the base is not limited to such a shape since it could also have a curved shaped as shown by base 210 of barricade sign 200 in FIG. 2 (barricade sign 220 is shown in closed position). The shape of the base is configured to:

(1) support the lid that is used as a sign;

(2) provide a compartment to store road safety items; and (3) provide a safer construction so that a vehicle could potentially drive over (any part or all of) the base without causing damages, or at least minimizing any damages, to the vehicle. In other words, the layered or curved shape would enable the barricade sign to act more or less like a speed bump.

Compartment 130 preferably stores one or more items related to safety cones, warning/traffic signs such as roll up signs, and the likes that can be reduced to a small volume, or any other items related to road safety. Dimensions of compartment 130 can be designed or scaled to fit items intended to be stored inside the compartment and therefore are not limiting.

Figure 3:
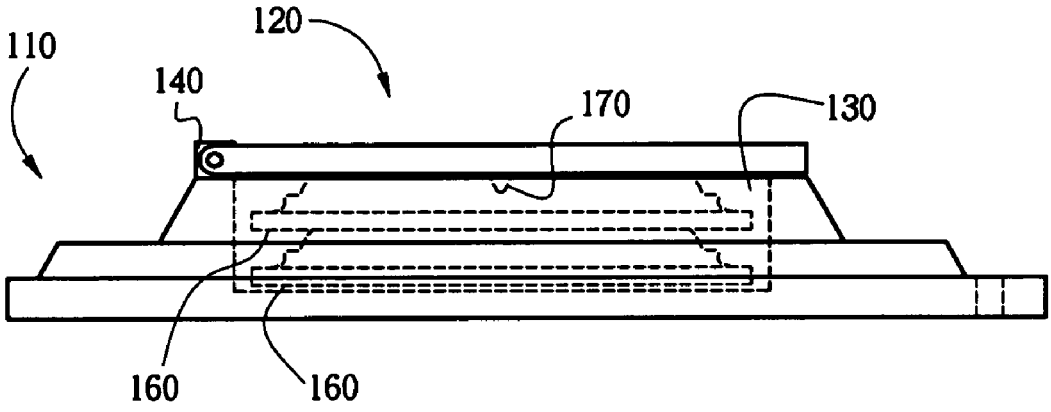
FIG. 3 shows exemplary embodiments of storing road safety items in the compartment of the barricade sign according to the present invention.
Figure 3:
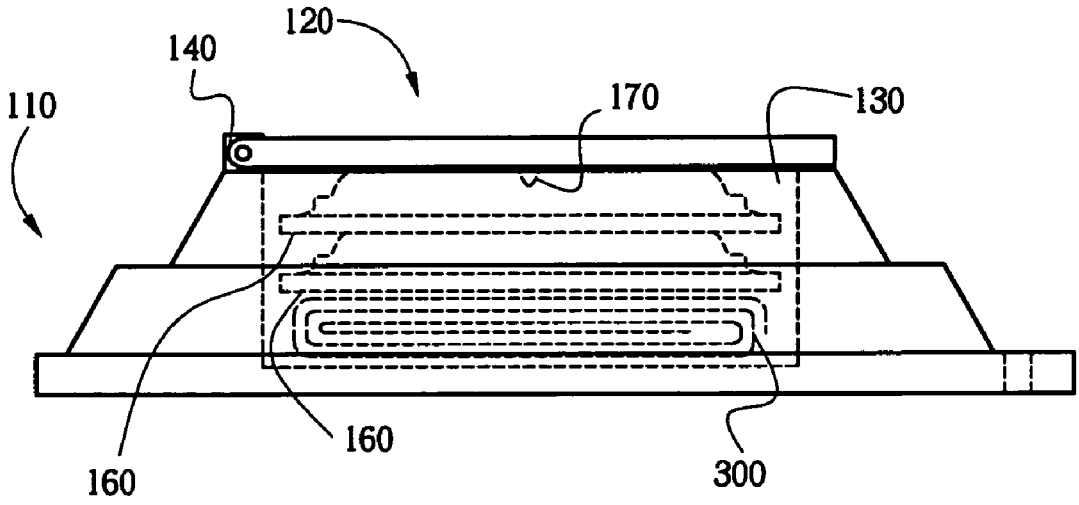

In one aspect, one or more non-rigid safety cones 160 could be stored in compartment 130. Preferably, compartment 130 stores one, two, or three safety cone(s). FIG. 3 shows two flexible safety cones 160 stored in compartment 130 in compact, small volume position. The number of safety cones depends on application and use. A preferred flexible safety cone has a flexible cone or conical part 164 that can be compressed into a small volume in a spring-loaded position. An example of such a flexible safety cone is disclosed in the above-referenced U.S. Pat. No. 6,766,760.

A positioning element 170 could be included at the inside of lid 120. Positioning element 170 preferably has a conical shape but is not limited to such a conical shape since it could also be cylindrical or square, as long as positioning element 170 removably fits inside top 162 of safety cone 160. The positioning element 170 holds top 162 of safety cone 160 in place inside of compartment 130 and prevents top 162 from slipping or sliding away relative to lid 120. Positioning element 170 could be assembled to the inside of lid 120 or integrally formed with lid 120. Positioning element 170 could also be a hollow element to fit around top 162.

Figure 2:
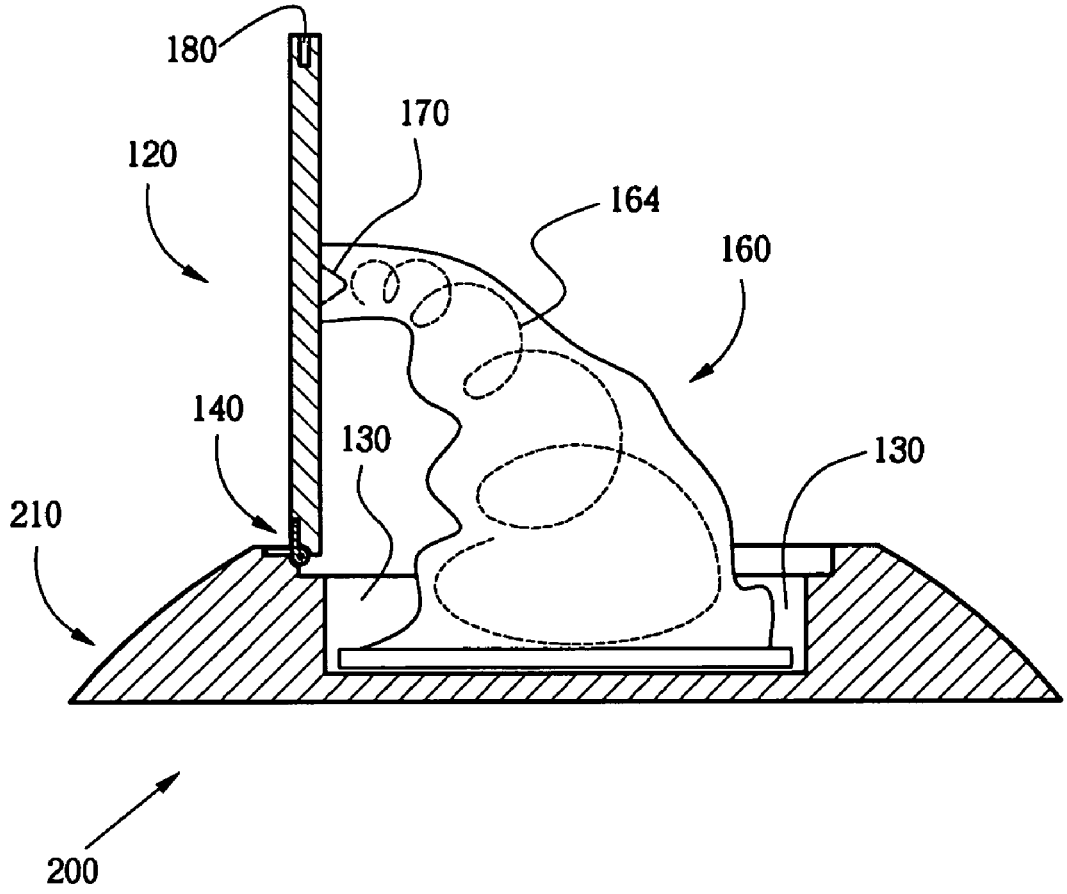
Figure 2:
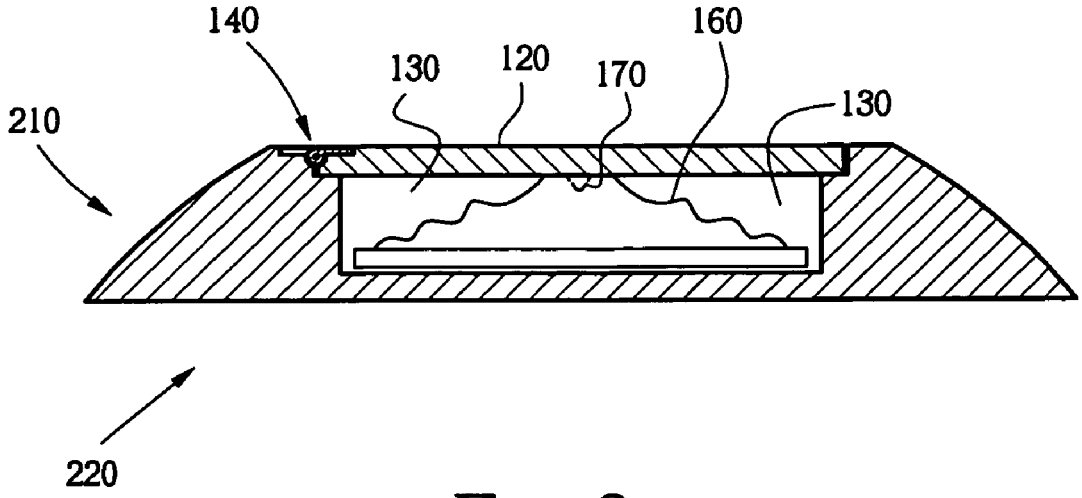

In some embodiments, a user places positioning element 170 inside top 162 of safety cone 160. Once in place, the user then pushes down lid 120 and therewith the flexible cone part 162 of safety cone 160 inside compartment 130. Flexible cone part 164 of safety cone 160 then gets into a spring-loaded position, as shown in FIG. 2. In case more than one safety cone is to be stored inside compartment 130, a user stacks the safety cones first, spring loads the stacked cones at the same time, and then stores them in a similar fashion as described above.

Figure 4:
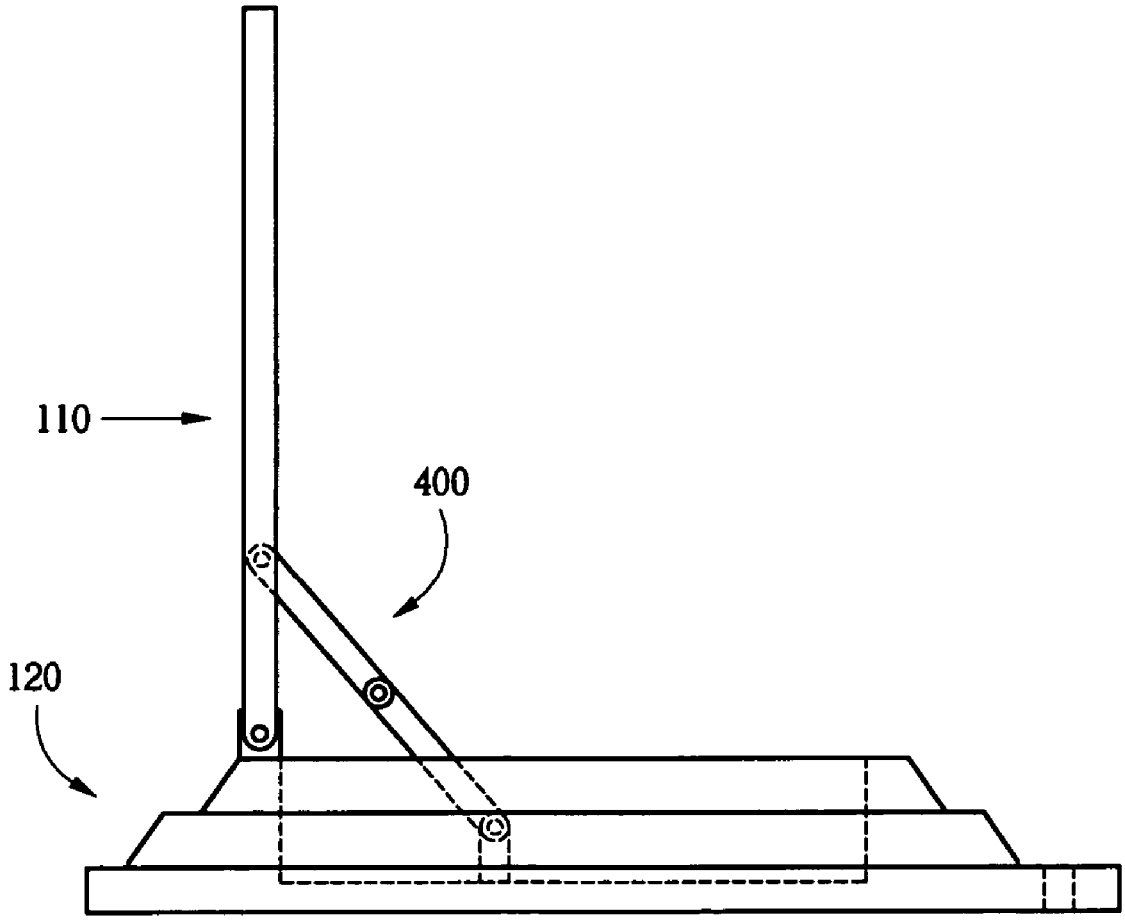
FIG. 4 shows an exemplary embodiment of holding the lid of the barricade sign in an upright position according to the present invention.
Figure 5:
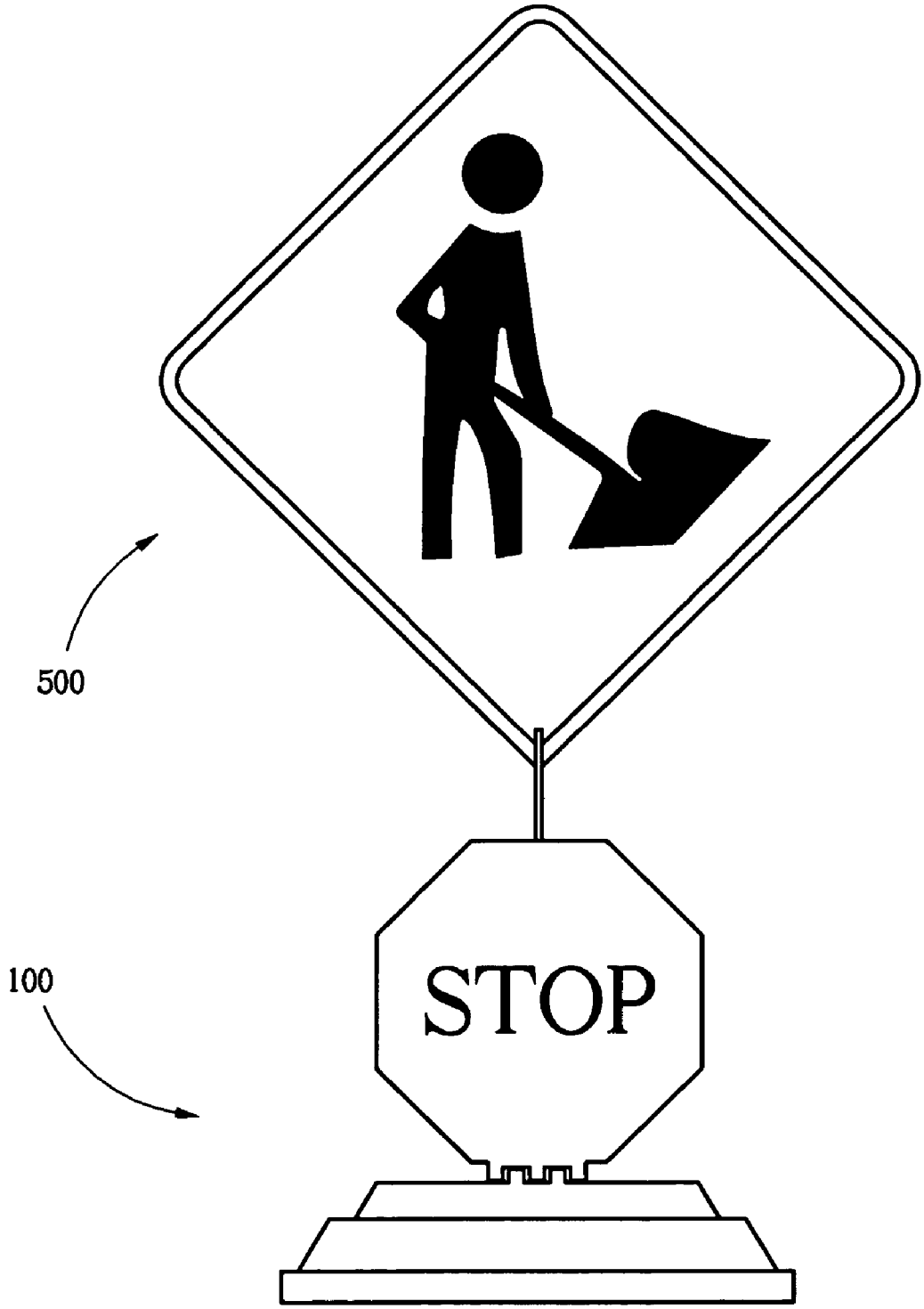
FIG. 5 shows an exemplary embodiment of a barricade sign as a base for a roll-up sign according to the present invention.

In case where one or more safety cones are stored in compartment 130 in a spring-loaded condition, once closing means 150 is released/opened, lid 120 will pop-up or at least be easily guided to an open position. Subsequently, a user can take out one or more of the stored item and hold lid 120 in a more or less upright position. A bracket, pin, hinged arm, or any type of means that will hold up the lid could be implemented to enable the lid holding position. An example of a such a support means, a bracket 400, is shown in FIG. 4. The holding position could also be enabled through a click mechanism integrated with the joint as common in the art. Such a means should be strong enough to keep the lid in the more or less up-right position, especially when other road safety signs or devices, e.g., a roll-up sign shown in FIG. 5, are integrated with the barricade sign.

Another consideration for the connection between the lid and the base, including the support means that holds up the lid, is to enable the lid and/or the support mean to collapse, fold, or possibly break upon impact, e.g., when a car hits or overrides the barricade sign. This feature would add to road safety and minimizes, possibly prevents, any damages to the vehicle.

The strength of the material for parts 110, 120 is important in cases where flexible safety cones are to be stored in the compartment in a spring-loaded position. Bending of parts 110, 120 due to the extension force of the spring-loaded cone part, should preferably be avoided or minimized. It might be necessary for parts 110, 120 to be reinforced, for instance, a change in thickness, in certain places or structural points.

Compartment 130 could also store a roll-up sign 300 as shown in FIG. 3. A de-assembled roll-up sign, for instance, in folded form, could be stored in compartment 130. The poles that are typically used to span the roll-up sign could also be stored in compartment 130. The poles could be telescopic poles, folded poles, interconnecting poles, or the like, as they are common in the art.

Lid 120 could include an opening 180 that could be used to insert and hold in place the vertical pole of a roll-up sign 500, as shown in FIG. 5. The barricade sign would then serve as a base for the roll-up sign. The type of roll-up sign to be used in combination with the barricade sign could be any type of conventional roll-up sign as they are known in the art.

In another embodiment, the roll-up sign could be improved by having a mesh-like material with or without reflective material. The mesh-like material would be advantageous to allow wind, rain or potentially sand or dirt from a wind gusts or a storm to pass through. The roll-up sign would then less likely act like a sail since such a sail action would jeopardize the stability of the barricade sign.

Figure 6:
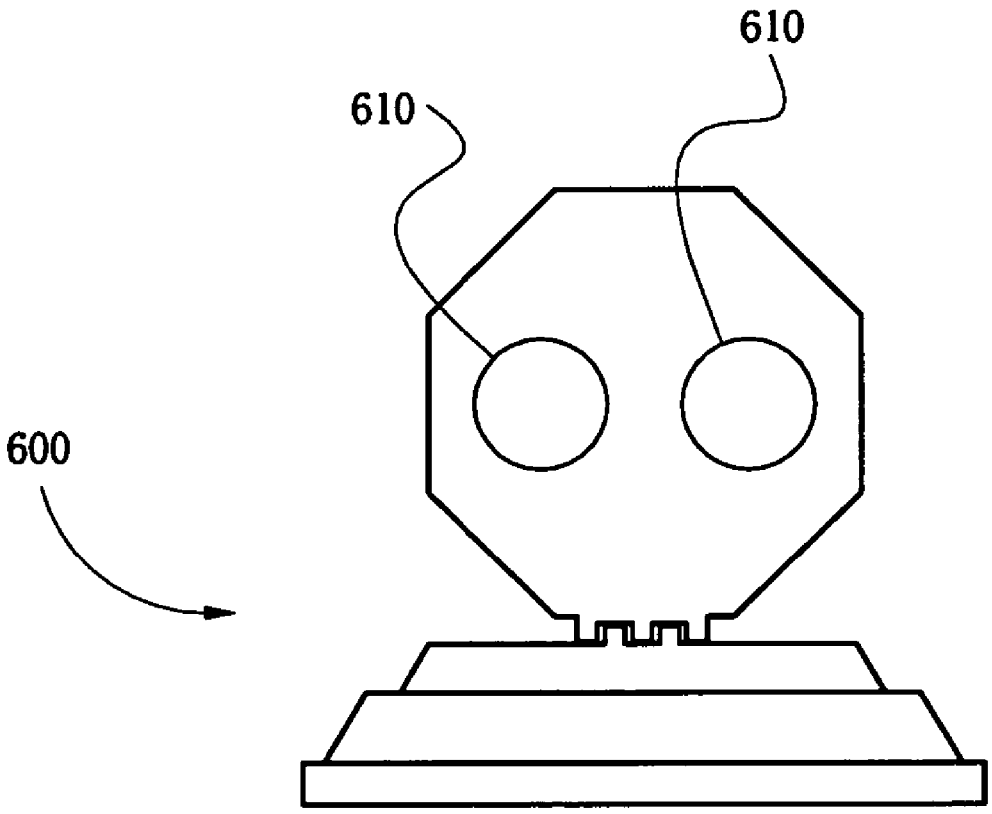
FIG. 6 shows an exemplary embodiment of lights as part of the lid according to the present invention.

In another aspect, the lid of the barricade sign 600 could include one or more lights 610 to alert or warn traffic as shown in FIG. 6. The lights could be battery operated or solar powered. The lights could be removably placed in a recess in the lid or removably placed on the outside of the lid. The lid could also include a fog light. The lights could automatically turn on when the lid opens, could be manually operated, or could be operated through a sensor that sense changes in visibility. The lights could also be stored inside the lid and pop up, pop out or slide out when the lid is opened to a more or less vertical position.

Figure 7:
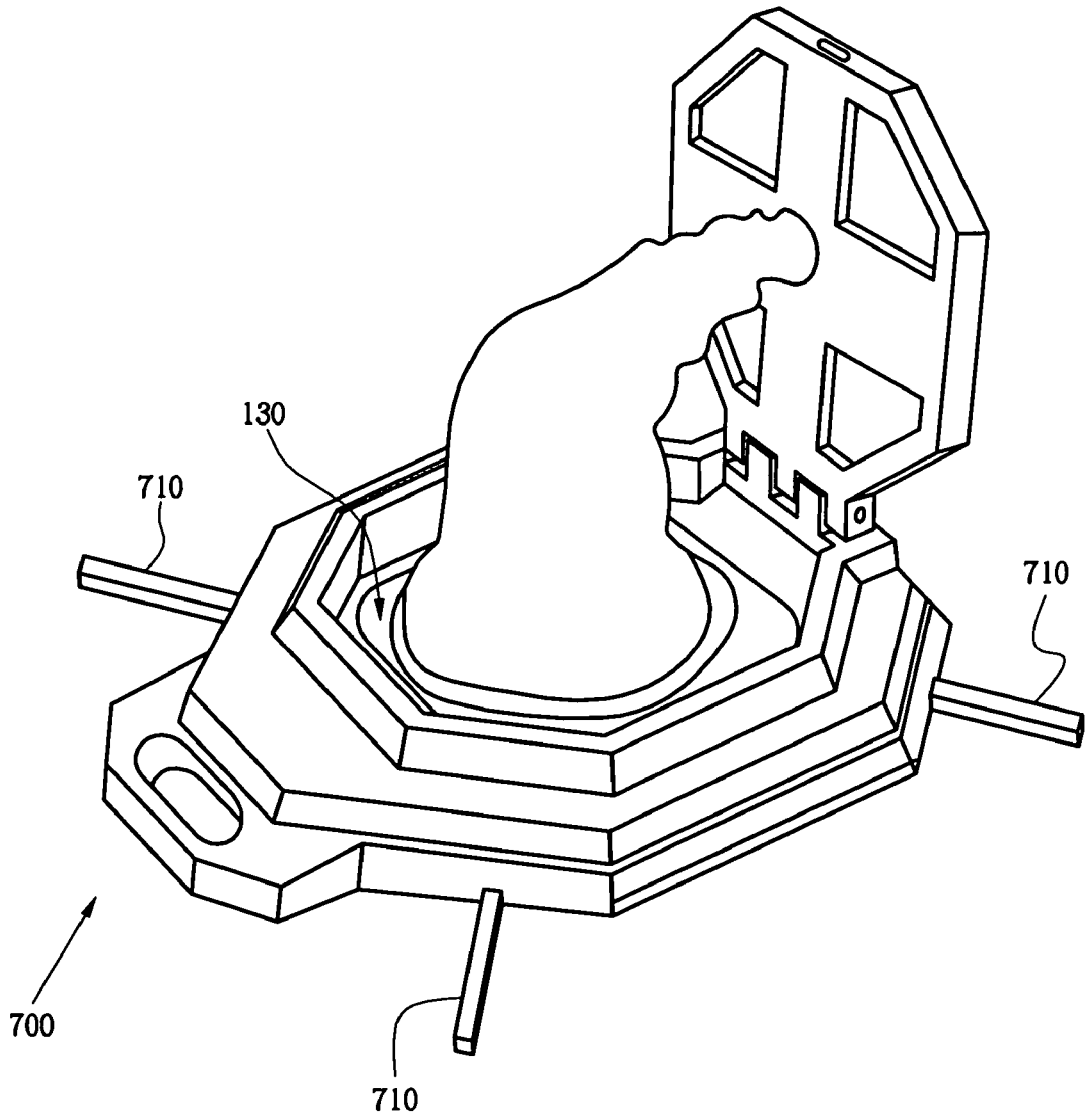
FIG. 7 shows an exemplary embodiment of stabilizers for the barricade sign according to the present invention.

The weight of the base should be sufficient enough to sustain 40 mph wind without moving away from the intended location and/or without falling over. In one aspect, the base of the barricade sign 700 could include stabilizers 710 in case where additional stability is necessary, as shown in FIG. 7. Stabilizers could be extended by pushing them from the inside of compartment 130 where they could be stored outward relative to the base though openings in the sides of the base. Stabilizers could be single elements or elements that could be extended through telescopic means.

In another aspect, a user could add weight to the compartment to provide more friction and potentially more stability. In yet another aspect, the bottom surface of the base could provide enough friction to avoid sliding away from its desired position and placement on the road or support surface. Friction could be established by a roughness or a pattern created to the bottom surface of the base. The barricade sign with or without a roll-up sign could be placed on the road, shoulder or even on a vehicle that is in a stand still or driving.

The base of the barricade sign could include a handle 190 so that it can be carried by a person. Handle 190 could be fixed to base 110. In one embodiment, handle 190 could be manufactured as an integral part of base 110. In another embodiment, handle 190 could be manufactured as a separate element and preferably pivotally connected to base 110.

Figure 8:
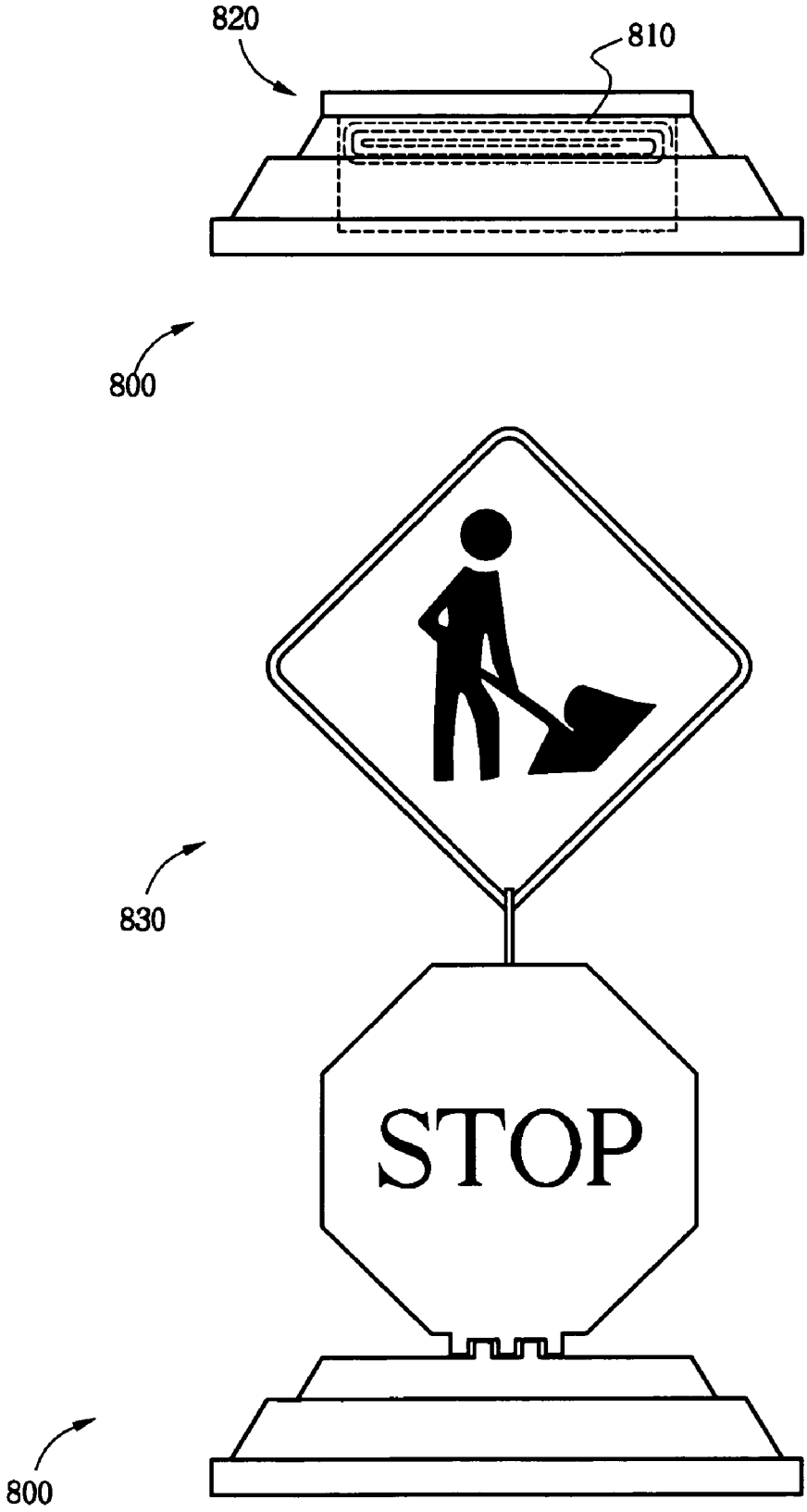
FIG. 8 shows an exemplary embodiment of a packaged roll-up sign that pops out and open as a fold-up sign according to the present invention.
Figure 9:
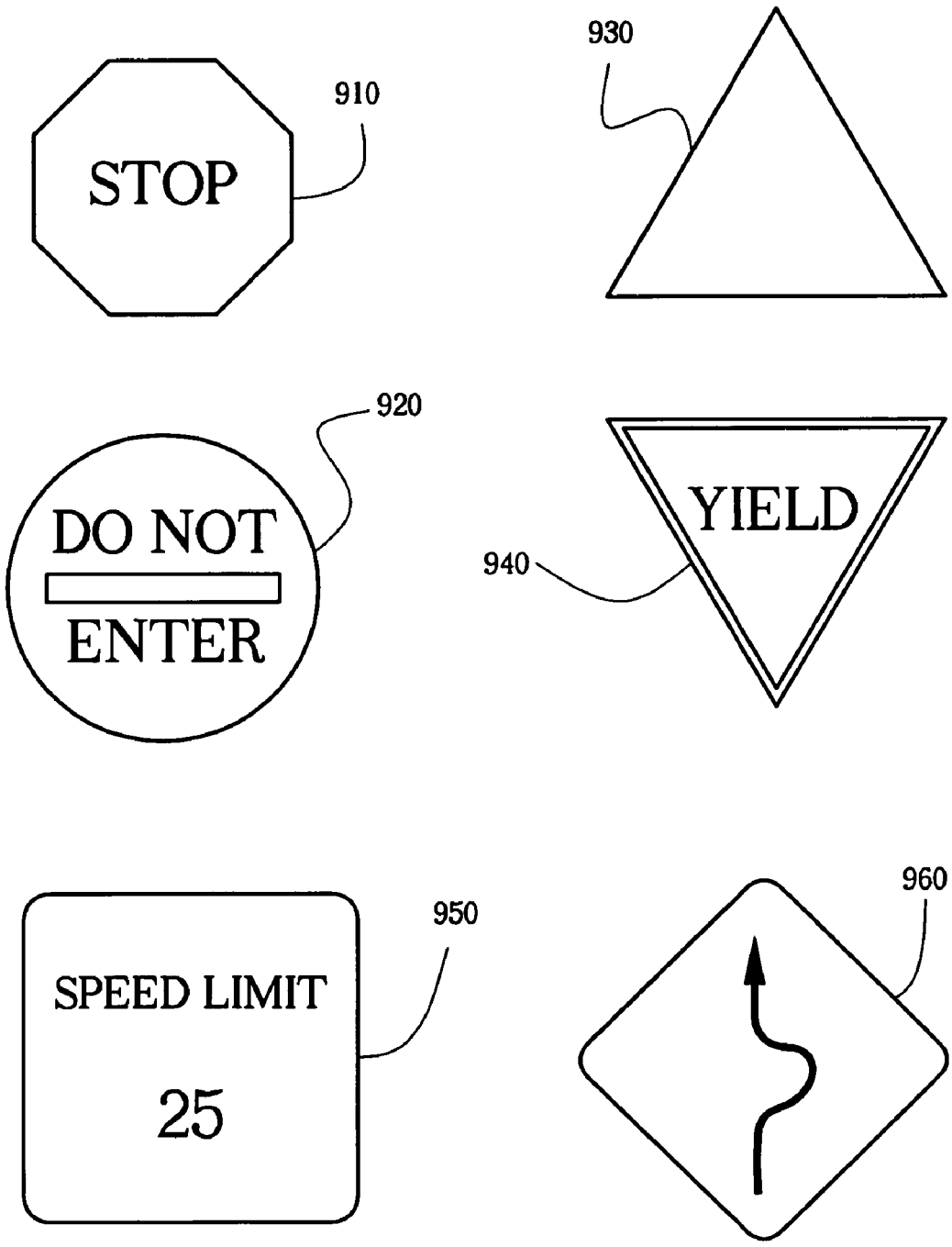
FIG. 9 shows exemplary embodiments signs for the lid according to the present invention.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For instance, a new type of roll-up sign could be used which could be folded up to a small package 810 that can be stored at the inside of the lid of the barricade sign 800 as shown in FIG. 8. When lid is in closed position 820, the folded roll-up sign is stored, but when lid opens up, either by hand or by means of a spring-loaded safety cone(s), the folded roll-up sign pops-open like some of the tents that are known in the art of tents and develops like a spread out roll-up sign 830.

Another variation is that the shape of the lid is not limited to an octagon 910, but could be any type of shape that is related to common traffic signs, such as a circle 920, a triangle (up 930 or down 940), square 950 or a diamond 960. Examples of other signs could be obtained from e.g. the Federal Highway Administration (FHA, See e.g. their www site at www.fhwa.dot.gov). Yet another variation is to use different types of recyclable materials for the barricade signs.

Figure 10A:
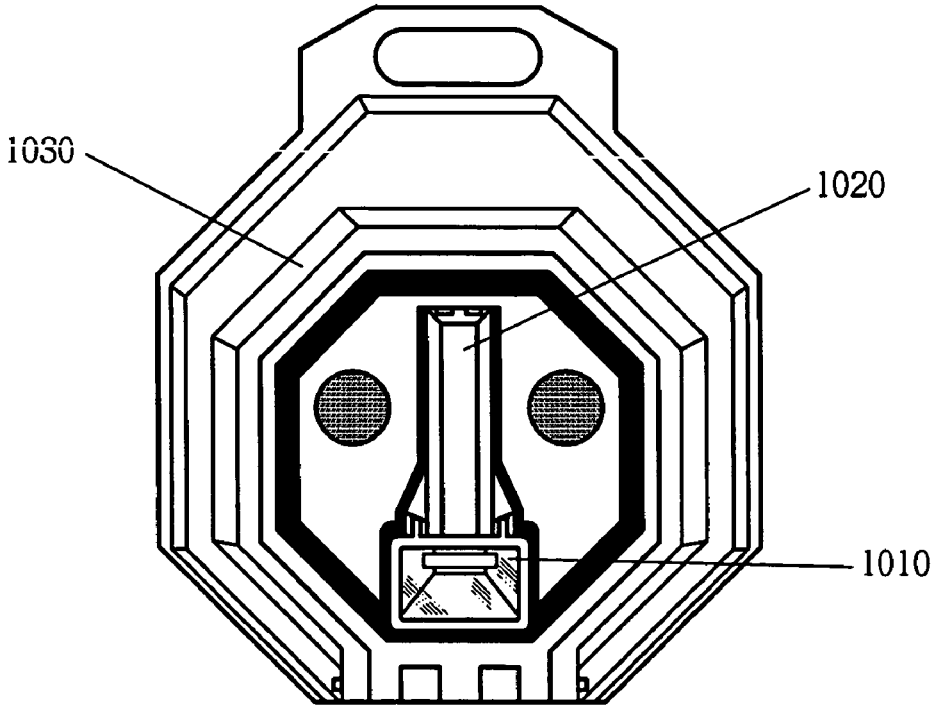
FIGS. 10–11 show exemplary embodiments of the present invention integrating a light.
Figure 10B:
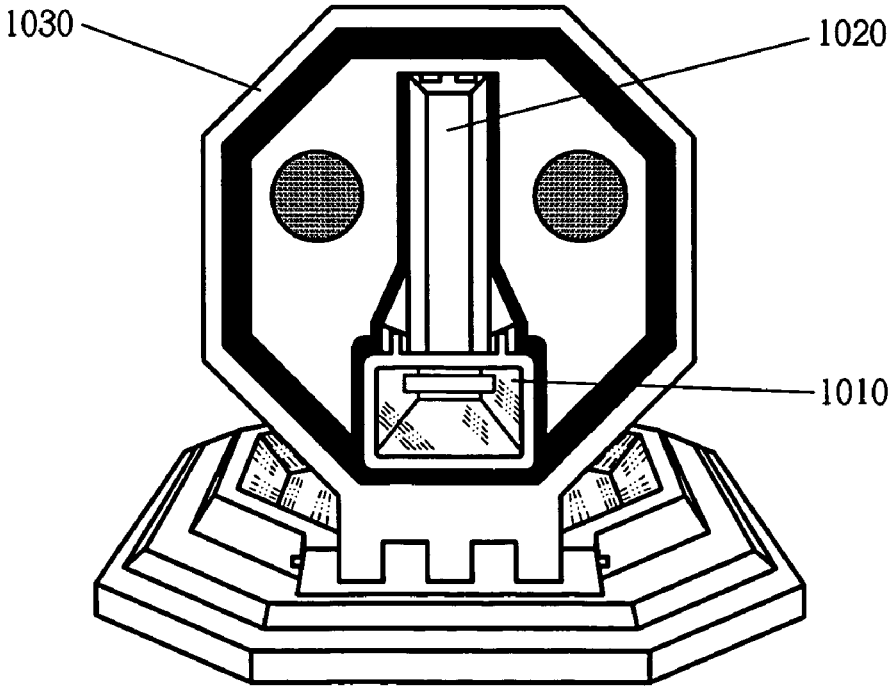
Figure 11:
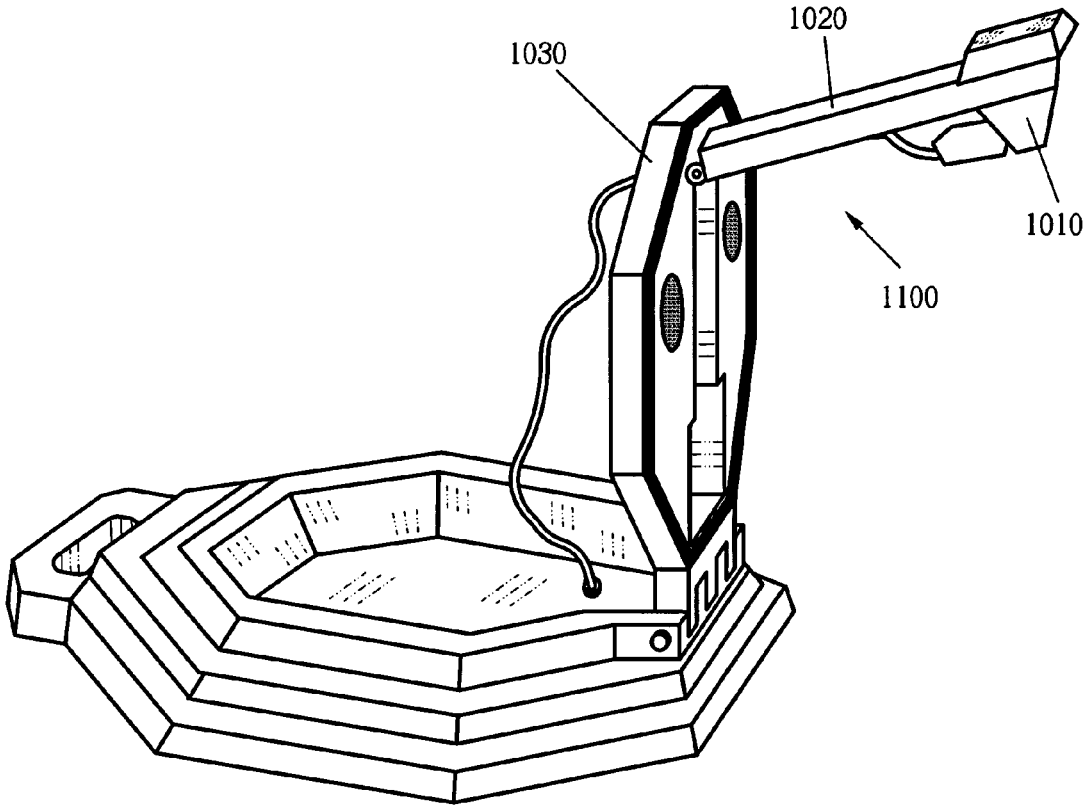

Still another variation is to have a light placed near the end of a bar element. The light and bar element could be stored in a recess in the lid. FIGS. 10A–B show an example, in closed and open positions, respectively, of a halogen lamp 1010 integrated on a bar 1020 storable in a recess in the outer surface of lid 1030. FIG. 11 shows the barricade sign of FIGS. 10A–B with its lid 1030 in an upright holding position and the bar 1020 in an upwardly tilted position 1100 such that the light source 1010 could be directed in a manner that alerts traffic.

The barricade sign can be used in combination with a roll-up sign to provide additional signage and warning to traffic. The barricade sign would improve road safety through its design (i.e. shape and material). Many other variations may be derived from the description contained herein by a person of ordinary skill in the art without departing from the spirit of the present invention. Accordingly, the scope of the present invention should be determined by the following claims and their legal equivalents.

I claim:

1. A barricade sign comprising:

a base with a compartment and one or more safety marker devices, each of which having a flexible conical part enabling said devices to be compressed in a reduced form;

a lid with an inner side and an outer side, wherein said inner side has a positioning element concentrically securing said one or more safety marker devices, said positioning element is firmly attached, fixed onto, or formed as part of said inner side at a central location thereof and said positioning element fits inside a top opening of said flexible conical part and prevents said flexible conical part from slipping or sliding away; and wherein said outer side implements a sign;

a connection means pivotally connecting said base and said lid; and a closing means for securely latching said lid onto said base.

2. The barricade sign of claim 1, further comprising:

a handle for carrying said barricade sign.

3. The barricade sign of claim 1, wherein said base and said lid are configured to withstand or counteract a spring force exerting from said flexible conical part.

4. The barricade sign of claim 1, further comprising a support means for supporting said lid in an upright holding position; wherein said support means movably joins said base and said lid; and wherein said support means is collapsible upon impact.

5. The barricade sign of claim 4, wherein said support means facilitates said barricade sign to resist up to and include 40 miles per hour wind.

6. The barricade sign of claim 1, wherein said base has a layered or curved configuration and a dimension that facilitates elimination or significant reduction in damages to a vehicle impacting said barricade sign.

7. The barricade sign of claim 1, wherein said base and said lid are made of plastic or rubber.

8. The barricade sign of claim 1, wherein said closing means is selected from the group consisting of a clasp, a latch, a strap, a lock, a clip, a fastener, a hook, a click-mechanism, or a combination thereof.

9. The barricade sign of claim 1, wherein said closing means is attached to, fixed on, formed part of, or integrated in either or both of said base and said lid.

10. The barricade sign of claim 1, wherein each safety marker device is compressible to said reduced form concentrically and substantially linearly from said top downwardly towards said base.

11. The barricade sign of claim 1, in which said barricade sign has a capacity to hold one, two, three, four, or more of said safety marker devices.

12. The barricade sign of claim 1, in which said compartment is configured or scaled for storing a disassembled or folded roll-up sign.

13. The barricade sign of claim 12, in which said lid includes a pole of said roll-up sign.

14. The barricade sign of claim 12, in which said roll-up sign comprises a mesh-like material to allow wind, rain, sand, or dirt to pass through, thereby enhancing stability of said barricade sign.

15. The barricade sign of claim 1, further comprising:

a light source integrated on said lid, in a recess of said lid, or on a bar movably jointed to said lid; wherein said light source is battery operated or solar powered.

16. The barricade sign of claim 15, wherein said lid is adjustable to an upright holding position and said bar is adjustable to an upwardly tilted position, thereby enabling directing said light source to suit different needs.

17. The barricade sign of claim 1, further comprising:

one or more stabilizing means coupled to said base for enhancing stability of said barricade sign, wherein said stabilizing means is telescopically extendible outwardly from said compartment.

* * * * *